United States Patent [19]

Kinney

[11] 3,941,039

[45] Mar. 2, 1976

[54] COOKING FUME REMOVAL

[75] Inventor: David William Kinney, Arlington Heights, Ill.

[73] Assignee: Air Distribution Associates, Inc., Wood Dale, Ill.

[22] Filed: Nov. 18, 1974

[21] Appl. No.: 524,505

[52] U.S. Cl. ..... 98/115 K; 55/DIG. 36; 126/299 R

[51] Int. Cl.[2] ..... F23J 11/00

[58] Field of Search ..... 126/299 R, 299 A, 299 B; 98/115 K; 55/DIG. 36

[56] References Cited

UNITED STATES PATENTS

| | | | |
|---|---|---|---|
| 913,465 | 2/1909 | Brouillet | 126/299 R |
| 1,463,242 | 7/1923 | Biggs | 126/299 R |
| 2,369,375 | 2/1945 | Sonntag | 55/DIG. 36 |
| 2,793,712 | 5/1957 | Graswich et al. | 126/299 A |
| 3,410,195 | 11/1968 | King | 98/115 K |
| 3,854,388 | 12/1974 | King | 98/115 K |

*Primary Examiner*—William F. O'Dea
*Assistant Examiner*—Ronald C. Capossela
*Attorney, Agent, or Firm*—Darbo, Robertson & Vandenburgh

[57] ABSTRACT

An exhaust hood over a cooking appliance has sides that extend down substantially closer to the cooking surface than does the front of the exhaust hood. A wall slants forwardly and upwardly from the rear of those sides to the top of the hood adjacent the front thereof. This wall has an opening through which the fumes are drawn to an exhaust duct, and a grease extractor positioned across that opening. At the front of the hood a baffle extends between the sides and rearwardly from the front of the hood in a horizontal direction.

13 Claims, 3 Drawing Figures

COOKING FUME REMOVAL

BACKGROUND AND SUMMARY OF THE INVENTION

Commercial establishments use large exhaust hoods over cooking surfaces, e.g. a fry plate, to remove the cooking fumes. For effective fume removal, it is necessary that large volumes of air be exhausted through these ducts and that a corresponding amount of fresh, exterior air enter the building at other locations. For example, with a canopy type hood, the National Fire Protection Association Code (No. 96, Appendix A) specifies that the exhaust air in cubic feet per minute should be between 100 and 150 times the entrance area (front, sides, etc.) of the hood in square feet. Since this same amount of air must necessarily be drawn in from the outside, the result is that there is a correspondingly increased load on the heating and/or air conditioning system of the building. Of course, this requires additional energy and is a corresponding expense to the operator of the business.

In an effort to alleviate this expense, various forms of "direct make-up air hoods" have been devised. These hoods have provision for drawing in air directly into the hood from the outside, and thus that air is not acted upon by the heating/air conditioning system of the building. This direct make-up air is then directed in streams within the hood in a manner intended to entrain the cooking fumes for removal through the hood. However, the codes applicable to exhaust hoods invariably require that a direct make-up air hood exhaust a greater quantity of air than would otherwise be the case. Thus, to a significant extent, the use of a direct air make-up hood is self-defeating because larger exhaust fans are then required, the larger exhaust fan being more expensive and using more energy. Direct make-up air hoods have the further disadvantage that, because of the larger volumes of air being handled, higher air velocities generally result. In general, high velocities usually cause turbulence in the capture and entrainment air streams, thus greatly reducing the efficiency of the hood for capture and removal of cooking fumes.

The present invention is directed to a method and apparatus for exhausting cooking fumes through a hood, without utilizing direct make-up air as discussed in the preceding paragraph, but more effectively entraining the cooking fumes in the air being exhausted from the building so that the quantity of air being exhausted can be reduced. Obviously, there is an enerby saving and thus a monetary saving to the extent that the heated or air conditioned air removed from the building is diminished. In the present invention, the sheet metal of the hood is so arranged that the air being drawn into the exhaust hood is directed so as to sweep through the space above the cooking surface and thereby more effectively entrain the cooking fumes for removal by that air.

Further objects and advantages will become apparent from the following description and drawing.

DESCRIPTION OF SPECIFIC EMBODIMENTS

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

Figure 1:
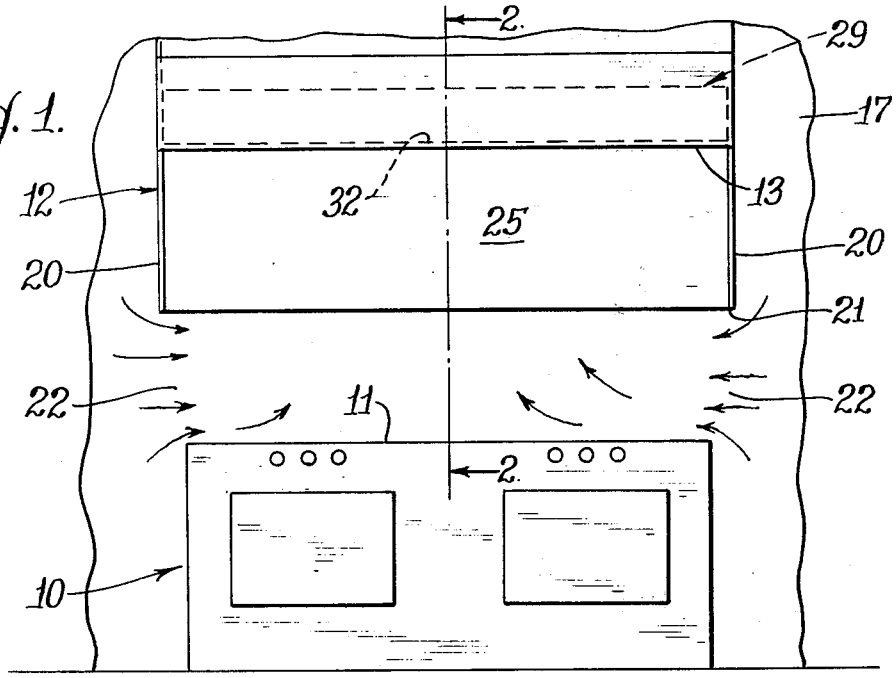
FIG. 1 is a front elevational view of a cooking appliance having above it an exhaust hood embodying the present invention.
Figure 2:
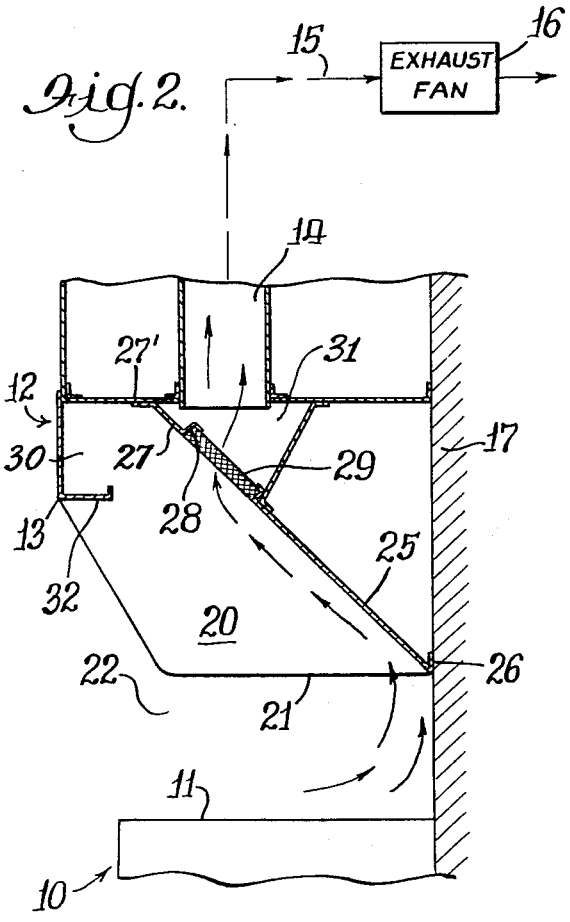
FIG. 2 is a section as seen at line 2—2 of FIG. 1.

FIGS. 1 and 2 illustrate a cooking appliance, generally 10, which, by way of example, has a heated frying surface 11. For removal of the fumes emanating from the food being fried on surface 11, an exhaust hood, generally 12, is positioned above the appliance. Necessarily, this hood must be open at the front for a substantial distance above the cooking surface to permit access of the cooks to the cooking operation. Thus, it is likely that the bottom edge or terminus 13 of the front of the hood will be 6½ or 7 feet or more above the floor, the cooking surface 11 being only about 30 inches or so above the floor. Codes relating to exhaust hoods are likely to require that the hood extend at least 6 inches outside of the planes extending vertically upward from the front and sides of the cooking surface to the appliance. An exhaust duct 14 communicates with the interior of the hood. As indicated by dashed line 15 an exhaust fan 16 withdraws air from duct 14 (thereby producing an air pressure within the hood that is lower than ambient) and discharges that air externally of the building 17 in which the appliance is used. As thus far described, the arrangement is representative of numerous conventional exhaust systems for cooking appliances.

In the present invention, sides 20 extend vertically downward from the sides of the exhaust hood 12. The bottom edge or terminus 21 of sides 20 are substantially below the bottom edge 13 of the front of the hood, but above the level of the cooking surface 11, thus leaving a space 22 between the bottom of the sides and the top of the cooking surface. Bottom edge 21 is horizontal with the result that space 22 is generally rectangular in shape. With a cooking surface 11 which has a front to back dimension of about forty inches or so, the front of the hood (as for example at the edge 13) would be about 47 inches or so from the wall against which the appliance 10 is positioned. In such an arrangement, the bottom edge 21 would extend about 36 inches out from the wall.

The side walls 20 should occupy about 50 percent to about 85 percent of the area between the level of the cooking surface 11 and the level of the bottom of the usual hood (i.e. the level of edge 13) or, to put it another way, the opening 22 should be between about 35 percent and about 50 percent of this latter space. The use of side openings 22 of this size results in a significant air flow inwardly from the sides of the cooking surface, as illustrated by the arrows in FIG. 1. This air flow sweeps across the space above the cooking surface 11 in an inwardly direction, entraining the cooking fumes for removal through the hood.

A wall 25 extends between sides 20 and slants upwardly toward the front of the hood. Thus, the wall has a bottom edge or terminus 26 at the level of the bottom edge 21 of the sides. This slanting wall is solid (i.e., imperforate) and free of discontinuities up to the level of the draft opening 28. Above opening 28 is an upper piece 27 of wall having its top edge 27' secured to the upper inner face of the hood 10. Positioned across opening 28 is a grease extractor 29. The grease extractor and the upper piece 27 of wall divide the space within the upper part of the hood 12 into a front portion 30 and a rear portion 31. Thus, to reach the exhaust duct 14, the cooking fumes must pass from the forwardly space 30 through the grease extractor 29 to the rearwardly space 31. The structure of this grease extractor (or the related sheet metal) is such that the air pressure (vacuum) is relatively uniform throughout its length, and is not concentrated at the location of duct 14 and lower at locations remote from the duct.

The inclination of slanting wall 25 should be between about 45° and about 60° from the horizontal. Thus, the building air entering the front access opening which exists between the cooking surface and edge 13 of the hood (as well as the air entering side openings 22) first sweeps rearwardly above the cooking surface and then moves along the front face of wall 25 forwardly and upwardly toward the front hood space 30. This is illustrated by the arrows at the right side of FIG. 2. At best, the air entering above a cooking surface and below a conventional hood only moves back and upwardly; however, with the slanting wall 25, the movement of the air in two directions in the space above the cooking surface is more effective in the entrainment of the cooking fumes. Furthermore, because of the fact that the slanting wall 25 serves to decrease the volume of the space above the cooking surface at the higher elevations above that surface, there is increased velocity of air movement the closer the air gets to discharge opening 28, i.e., in the higher elevations above cooking surface 11. This results in more effective fume removal than is the case with the conventional type hood.

Extending inwardly from the lower edge 13 of the front of the hood is a baffle 32. This baffle extends the full width of the hood. From front to back, the baffle extends between about 15 percent and about 20 percent of the front to back dimension of the hood, i.e., from front edge 13 to the adjacent wall of building 17. In the described embodiment, having the dimensions previously discussed, the baffle 32 has a front to back dimension (left to right in FIG. 2) of 8 inches.

With conventional hoods, there will occasionally be an outpouring of smoke along the front edge (corresponding to edge 13) of the hood. This often is due to a combination of factors such as unusually large volume of smoke arising from the cooking surface 11, excessive turbulence in the space immediately behind the front of the hood, a rapid change in the ambient air movement (e.g. gusts), etc. The presence of a baffle, such as that described in connection with baffle 32, greatly ameliorates this problem for two reasons: (1) air turbulence in the top front of the hood (i.e. above the baffle) is contained by the baffle and air flowing away from that space necessarily must flow horizontally to the rear rather than downward along the front of the hood; and (2) there will be an air flow across the bottom of the baffle in the front to rear direction (left to right in FIG. 2) which air flow will tend to force the smoke trapped in the hood and the smoke or cooking fumes reaching opening 28 at the top of slanting wall 25 into moving directly toward the escape opening 28.

Figure 3:
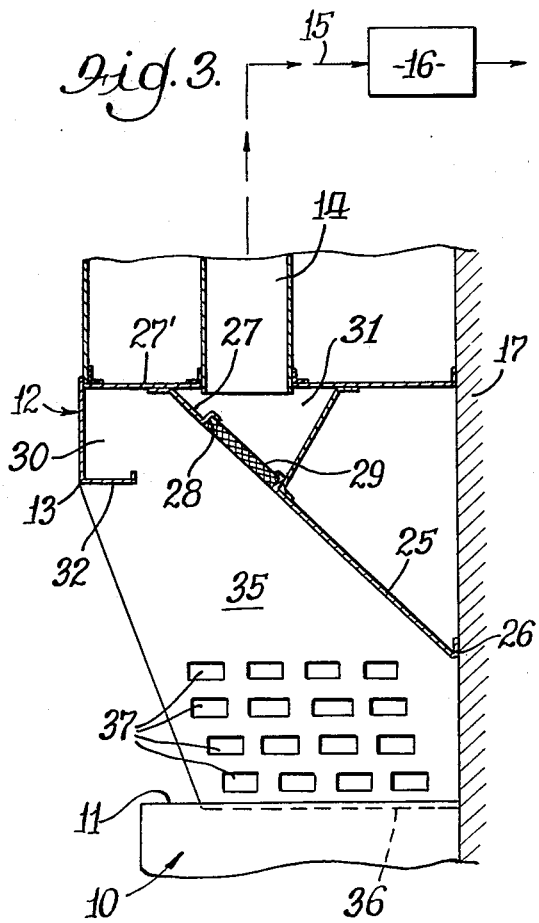
FIG. 3 is a view similar to that of FIG. 2 but illustrating an alternative embodiment of the invention.

FIG. 3 illustrates one of the alternative procedures that may be followed for providing openings of at least 35 percent in the side walls between the bottom of the hood and the cooking surface 11. In this embodiment, the side walls 35 extend down so that their bottom edge 36 is about at the level of the cooking surface 11. However, these side walls still remain set out sideways from the cooking surface a distance of 6 inches or so, so that there is an opening between the side walls 35 and the cooking surface 11 at the level of the cooking surface. In addition to this opening, the side walls have a plurality of openings 37 through the wall. Through all of these various openings, there will be an inward flow of air from the sides which sweeps across the cooking surface 11 in the general direction of the center to capture the cooking fumes and move them toward the outlet 28. The total area of the openings in relation to the area between the bottom of the hood (e.g. the level of edge 13) and the level of the cooking surface should be within the range previously discussed to provide the best inward air movement for capture of the cooking fumes.

The openings 37 should individually be relatively large in size. The smaller the openings, the more that must be required with the result that there tends to be greater turbulence immediately inside the side walls in the area of the openings. Such turbulence reduces the effectiveness of the inward air streams to moving the cooking fumes in the pattern illustrated in FIG. 1. In this respect, the optimum is a single large opening at each side, which optimum is represented by the embodiment illustrated in FIGS. 1 and 2.

I claim:

1. In an exhaust hood used above a cooking appliance having a top with front, sides and a rear at approximately a first level, which hood has a front with a bottom terminus spaced at a second level above the top of the appliance, sides and a back, said hood having an exhaust duct at the top which is adapted to be connected to means for withdrawing air from within the hood so that an air pressure below ambient exists within the hood, the improvement comprising:

side wall means at each side extending downwardly from the hood at said second level, said side wall means defining openings between said levels which openings are between 35 and 50 percent of the area between said levels in a generally vertical plane, whereby at said sides said air pressure below ambient causes streams of air to flow inwardly above the cooking surface generally toward the center of the cooking surface; and a wall slanting upwardly from rear to front, said slanting wall extending approximately from one side wall means to the other side wall means, having a bottom between said levels and having a top not substantially lower than said second level.

2. In an exhaust hood as set forth in claim 1, wherein said side wall means have bottom terminuses above said first level and said openings exist between said bottoms and said first level.

3. In an exhaust hood as set forth in claim 1, wherein said openings are generally rectangular.

4. In an exhaust hood as set forth in claim 1, wherein said slanting wall is inclined at an angle of between about 45 and about 60° from the horizontal and the rear of the slanting wall is vertically above the rear of the appliance.

5. In an exhaust hood as set forth in claim 4, including an approximately horizontal baffle extending rearwardly from said bottom edge a distance equal to about 15 to 20 percent of the distance from said edge horizontally to a point vertically above the rear of said appliance.

6. In an exhaust hood used for removing cooking fumes above a cooking appliance having a top with front, sides and a rear at approximately a first level, which hood has a front with a bottom edge spaced at a second level above the top of the appliance, a top, sides and a back, said hood having an exhaust duct at the top thereof which is adapted to be connected to means for withdrawing air from within the hood so that an air pressure below ambient exists within the hood, the improvement comprising:

a wall slanting upwardly from rear to front, said slanting wall having a bottom between said levels and having a top not substantially lower than said second level, said slanting wall being solid, means above the top of said wall defining a space through which air can flow to reach said duct.

7. In an exhaust hood as set forth in claim 6, wherein said wall is substantially free of discontinuities between said bottom and said top thereof.

8. In an exhaust hood as set forth in claim 7, wherein said slanting wall is inclined at an angle of between about 45 and about 60° from the horizontal and the rear of the slanting wall is vertically above the rear of the appliance.

9. In an exhaust hood as set forth in claim 6, and wherein the hood, top, sides and back define a space open in the downward direction for receiving the cooking fumes, the further improvement comprising:

an upper wall above said second level and means between said two walls and defining an opening between the two walls, said means and said upper wall dividing said space into front and rear portions, said duct communicating with said rear portion.

10. In an exhaust hood as set forth in claim 9, including baffle means between said sides contiguous with said bottom edge for causing the air flowing inwardly below the front of the hood to be directed transverse to the cooking fumes arriving at the top of the slanting wall.

11. In an exhaust hood as set forth in claim 10, wherein said baffle means comprises an approximately horizontal baffle extending rearwardly from said bottom edge a distance equal to about 15 to 20 percent of the distance from said edge horizontally to a point vertically above the rear of said appliance.

12. The method of improving the removal of cooking fumes from above a cooking appliance having an exhaust hood thereabove through which an exhaust draft is drawn, said method comprising the steps of obstructing between about fifty and about eighty-five percent of the area between the sides of the appliance and the sides of the hood whereby an inward flow of air of higher velocity is produced through the remaining open area at said sides, blocking the flow of fumes from the rear part of the cooking appliance from proceeding vertically upward into the hood and directing the flow of the blocked fumes into the hood at the forwardly part thereof.

13. The method as set forth in claim 12, including the additional step of directing a flow inwardly just below the front of the hood to impinge on said rising and forwardly moving fumes to overcome, at least in part, the forward movement of said fumes.

* * * * *